US010487655B2

(12) United States Patent
Faulkner et al.

(10) Patent No.: US 10,487,655 B2
(45) Date of Patent: Nov. 26, 2019

(54) PUMPABLE TWO COMPONENT RESIN

(71) Applicant: J-LOK Co., Pittsburgh, PA (US)

(72) Inventors: Dakota Faulkner, New Kensington, PA (US); John C. Stankus, Canonsburg, PA (US); Richard Wharton, Irvona, PA (US); Lumin Ma, Pittsburgh, PA (US)

(73) Assignee: J-LOK Co., Pittsburgh, PA (US)

( * ) Notice: Subject to any disclaimer, the term of this patent is extended or adjusted under 35 U.S.C. 154(b) by 0 days.

(21) Appl. No.: 15/549,463

(22) PCT Filed: Mar. 2, 2016

(86) PCT No.: PCT/US2016/020347

§ 371 (c)(1),
(2) Date: Aug. 8, 2017

(87) PCT Pub. No.: WO2016/141008

PCT Pub. Date: Sep. 9, 2016

(65) Prior Publication Data

US 2018/0030831 A1 Feb. 1, 2018

Related U.S. Application Data

(60) Provisional application No. 62/127,450, filed on Mar. 3, 2015, provisional application No. 62/286,686, filed on Jan. 25, 2016.

(51) Int. Cl.
*E21D 20/02* (2006.01)

(52) U.S. Cl.
CPC ..... *E21D 20/028* (2013.01)

(58) Field of Classification Search
CPC combination set(s) only.
See application file for complete search history.

(56) References Cited

U.S. PATENT DOCUMENTS 3,920,223 A * 11/1975 Krueger ..... B01F 7/00408 261/DIG. 26
4,229,124 A 10/1980 Frey et al.
4,322,183 A * 3/1982 Ciavatta ..... E21D 20/02 405/259.5
4,509,903 A 4/1985 Fram
6,793,445 B1 9/2004 Charlton et al.
(Continued)

FOREIGN PATENT DOCUMENTS

AU 2457484 A 8/1984
CN 202883286 U 4/2013
(Continued)

*Primary Examiner* — Kyle Armstrong
(74) *Attorney, Agent, or Firm* — The Webb Law Firm

(57) ABSTRACT

A pumpable resin system for installation of mine roof bolts includes a resin reservoir configured to receive resin, a catalyst reservoir configured to receive catalyst, a resin pump arrangement in fluid communication with the resin reservoir, a catalyst pump arrangement in fluid communication with the catalyst reservoir, a delivery line in fluid communication with at least one of the resin pump arrangement and the catalyst pump arrangement, and a bolter arm configured to drill boreholes and install mine roof bolts. The delivery line is configured to deliver resin and catalyst from the resin reservoir and the catalyst reservoir to a borehole via the bolter arm.

5 Claims, 18 Drawing Sheets

(56) References Cited

U.S. PATENT DOCUMENTS

| | | | | |
|---|---|---|---|---|
| 2004/0057853 | A1 | 3/2004 | Ross et al. | |
| 2007/0194474 | A1* | 8/2007 | Nagy | B29C 45/531 264/40.5 |
| 2007/0264088 | A1 | 11/2007 | Richter | |
| 2007/0297862 | A1 | 12/2007 | Giraldo et al. | |
| 2010/0183379 | A1 | 7/2010 | Simmons et al. | |
| 2011/0070035 | A1 | 3/2011 | Ricardo | |
| 2012/0155971 | A1* | 6/2012 | Schmidt | E21D 20/023 405/259.6 |
| 2012/0219365 | A1* | 8/2012 | Podesser | E21D 20/025 405/259.1 |
| 2014/0140773 | A1 | 5/2014 | Brown | |
| 2016/0130778 | A1* | 5/2016 | Levey | E21D 20/02 405/259.1 |

FOREIGN PATENT DOCUMENTS

| | | | |
|---|---|---|---|
| DE | 102007008966 | A1 | 9/2007 |
| RU | 2202042 | C2 | 10/2003 |
| SU | 1702082 | A1 | 12/1991 |
| WO | 2009092659 | A2 | 7/2009 |
| WO | 2013170312 | A1 | 11/2013 |
| WO | 2014190382 | A1 | 12/2014 |
| WO | 2014190385 | A2 | 12/2014 |

* cited by examiner

PUMPABLE TWO COMPONENT RESIN

CROSS-REFERENCE TO RELATED APPLICATIONS

This application is the United States national phase of International Application No. PCT/US2016/020347 filed Mar. 2, 2016, and claims benefit of United States Provisional Patent Application Nos. 62/127,450 and 62/286,686, filed Mar. 3, 2015 and Jan. 25, 2016, respectively, the disclosures of which are hereby incorporated in their entirety by reference.

BACKGROUND OF THE INVENTION

Field of the Invention

The present invention relates to a two component resin and, more particularly, to a pumpable two component resin system and method for the installation of mine roof bolts.

Description of Related Art

The roof of a mine is conventionally supported by tensioning the roof with steel bolts inserted into boreholes drilled in the mine roof that reinforce the unsupported rock formation above the mine roof. The mine roof bolt may be anchored mechanically to the rock formation by engagement of an expansion assembly on the distal end of the mine roof bolt with the rock formation. Alternatively, the mine roof bolt may be adhesively bonded to the rock formation with a resin bonding material inserted into the borehole. A combination of mechanical anchoring and resin bonding may also be employed by using both an expansion assembly and resin bonding material.

When resin bonding material is utilized, the bonding material penetrates the surrounding rock formation to adhesively join the rock strata and to firmly hold the roof bolt within the borehole. Resin is typically inserted into the mine roof borehole in the form of a two component plastic cartridge having one component containing a curable resin composition and another component containing a curing agent (catalyst). The two component resin cartridge is inserted into the blind end of the borehole and the mine roof bolt is inserted into the borehole such that the end of the mine roof bolt ruptures the two component resin cartridge. Upon rotation of the mine roof bolt about its longitudinal axis, the compartments within the resin cartridge are shredded and the components are mixed. The resin mixture fills the annular area between the borehole wall and the shaft of the mine roof bolt. The mixed resin cures and binds the mine roof bolt to the surrounding rock. The mine roof bolt is typically rotated via a drive head.

SUMMARY OF THE INVENTION

In one aspect, a pumpable resin system for installation of mine roof bolts includes a resin reservoir configured to receive resin, a catalyst reservoir configured to receive catalyst, a resin pump arrangement in fluid communication with the resin reservoir, a catalyst pump arrangement in fluid communication with the catalyst reservoir, a delivery line in fluid communication with at least one of the resin pump arrangement and the catalyst pump arrangement, and a bolter arm configured to drill boreholes and install mine roof bolts. The delivery line is configured to deliver resin and catalyst from the resin reservoir and the catalyst reservoir to a borehole via the bolter arm.

The delivery line may be secured to the bolter arm and moveable relative to the bolter arm. The delivery line may include a resin line in fluid communication with the resin pump arrangement and a catalyst line in fluid communication with the catalyst pump arrangement. The resin line and the catalyst line may be received by a static mixer, with the delivery further including a grout tube is in fluid communication with the static mixer and configured to deliver a resin/catalyst mix into a borehole. The system may further include an inhibitor reservoir, an inhibitor pump arrangement, and an inhibitor line in fluid communication with the inhibitor pump arrangement, with the inhibitor line configured to deliver inhibitor from the inhibitor reservoir to the borehole to define a fast set section and a slow set section within a borehole. The resin pump arrangement may include a resin cylinder pump and the catalyst pump arrangement may include a catalyst cylinder pump, with the resin cylinder pump and the catalyst cylinder pump are slaved together and controlled by a hydraulic piston and hydraulic pump.

The resin pump arrangement may include a resin supply pump in fluid communication with the resin cylinder pump and the catalyst pump arrangement may include a catalyst supply pump in fluid communication with the catalyst cylinder pump. The resin reservoir and the catalyst reservoir may each include an auger configured to receive and mix cartridges containing resin or catalyst. The resin reservoir may be a resin feed cylinder configured to receive a resin cartridge and the catalyst reservoir may be a catalyst feed cylinder configured to receive a catalyst cartridge, with the resin feed cylinder and the catalyst feed cylinder each comprising a cap. The cap of the resin feed cylinder may define a gap between the cap of the resin feed cylinder and the resin feed cylinder, and the cap of the catalyst feed cylinder may define a gap between the cap of the catalyst feed cylinder and the catalyst feed cylinder, where the gaps are configured to allow air to escape the respective resin feed cylinder and the catalyst feed cylinder during compression of resin and catalyst cartridges within the respective resin feed cylinder and the catalyst feed cylinder.

In a further aspect, a method of installing a mine roof bolt includes inserting a delivery line into a borehole using a bolter arm, injecting grout into the borehole using the delivery line, retracting the delivery line from the borehole using the bolter arm, and installing a mine roof bolt in the borehole using the bolter arm by inserting the mine roof bolt into the borehole and rotating the mine roof bolt.

The grout may include resin and a catalyst with the method further including supplying the resin from a resin reservoir via a resin pump arrangement, and supplying the catalyst from a catalyst reservoir via a catalyst pump arrangement. The method may include actuating a hydraulic piston to supply the resin and catalyst to the delivery line. The method may also include supplying an inhibitor from an inhibitor reservoir to the borehole, with the inhibitor configured to react slower with the resin than the catalyst reacts with the resin to define a fast set section and a slow set section within the borehole. The inhibitor may be supplied from the inhibitor reservoir via an inhibitor pump arrangement and an inhibitor line in fluid communication with the inhibitor pump arrangement. The delivery line may be secured to the bolter arm and moveable relative to the bolter arm.

In another aspect, a method of installing a mine roof bolt includes inserting a delivery line into a borehole, injecting resin and catalyst into the borehole using the delivery line along at least a portion of a length of the borehole, removing the delivery line from the borehole, inserting a mine roof bolt into the borehole, and mixing the resin and catalyst using the mine roof bolt.

The delivery line may be inserted and removed from the borehole using a bolter arm. The mine roof bolt may be inserted into the borehole and the resin and catalyst is mixed using the bolter arm. The method may include supplying the resin from a resin reservoir via a resin pump arrangement, and supplying the catalyst from a catalyst reservoir via a catalyst pump arrangement. The method may also include actuating a hydraulic piston to supply the resin and catalyst to the delivery line. The method may further include supplying an inhibitor from an inhibitor reservoir to the borehole, with the inhibitor configured to delay a reaction between the resin and the catalyst for a portion of a length of the borehole.

These and other features and characteristics of the system will become more apparent upon consideration of the following description with reference to the accompanying drawings, all of which form a part of this specification, wherein like reference numerals designate corresponding parts in the various figures. It is to be expressly understood, however, that the drawings are for the purposes of illustration and description only and are not intended as a definition of the limits of the invention. As used in the specification, the singular form of "a", "an", and "the" include plural referents unless the context clearly dictates otherwise.

DETAILED DESCRIPTION

Figure 1:
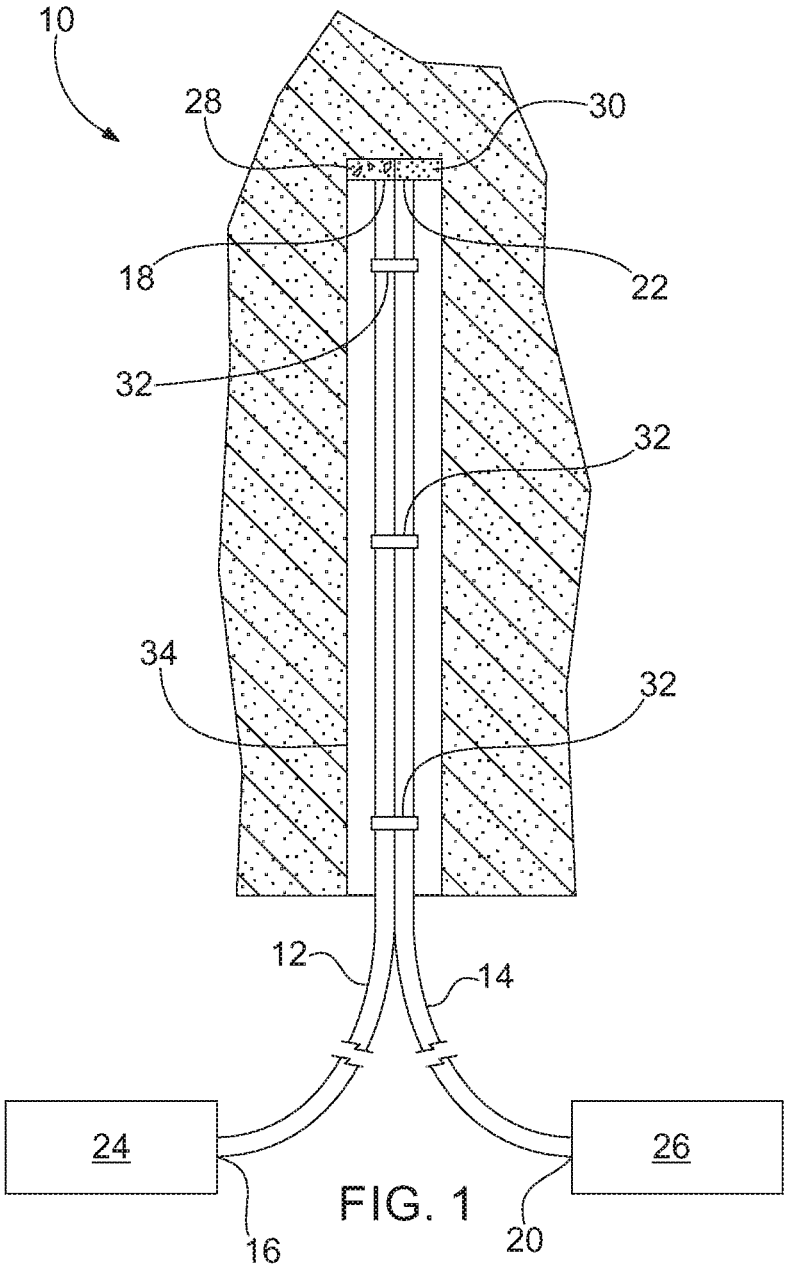
FIG. 1 is an elevational view of a pumping system and method for installing a mine roof bolt according to one aspect of the invention showing the filling of a borehole.

Aspects of the present invention will now be described with reference to the accompanying figures. For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is to be understood that the specific apparatus illustrated in the attached figures and described in the following specification is simply an exemplary aspect of the present invention. Hence, specific dimensions and other physical characteristics related to the aspects disclosed herein are not to be considered as limiting.

Figure 2:
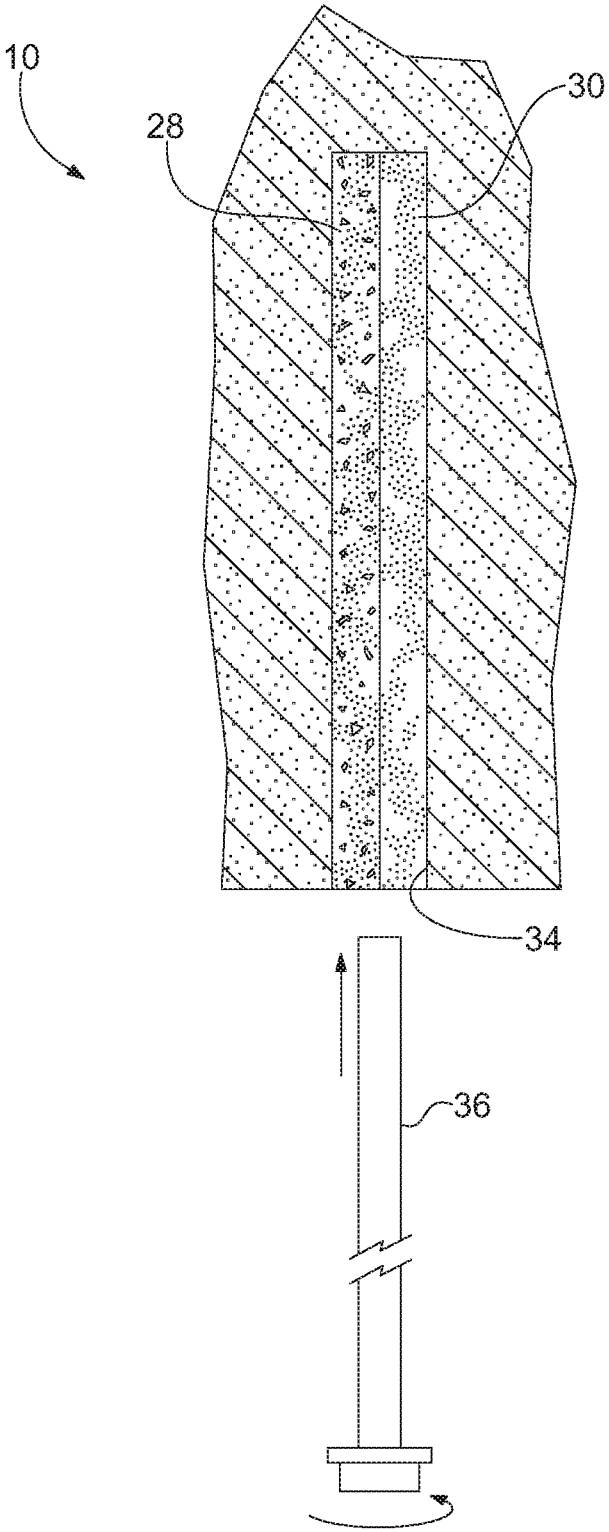
FIG. 2 is an elevational view of the system and method of FIG. 1 showing a mine roof bolt being inserted into a borehole.
Figure 3:
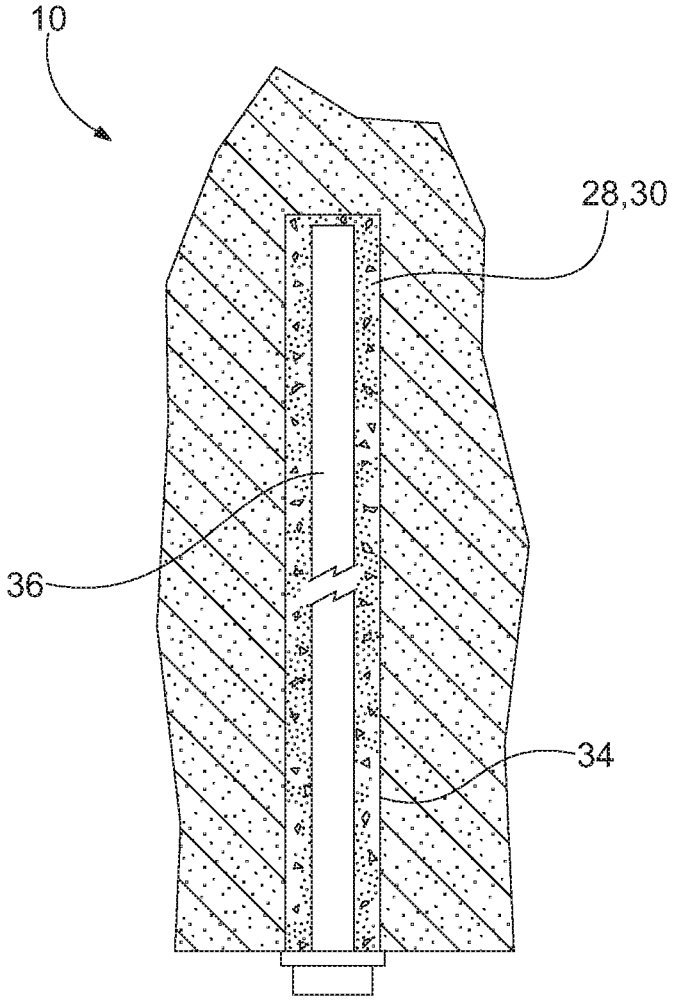
FIG. 3 is an elevational view of the system and method of FIG. 1 showing the mine roof bolt installed.

Referring to FIGS. 1-3, one aspect of a pumpable two component resin system 10 includes a delivery line formed by a resin line 12 and a catalyst line 14 that are configured to deliver grout, such as a resin 28 and a catalyst 30 to a borehole. The resin line 12 and the catalyst line 14 each have an inlet 16, 20 and an outlet 18, 22. The inlet 16 of the resin line 12 is connected to and in fluid communication with a resin pump 24. The inlet 20 of the catalyst line 14 is connected to and in fluid communication with a catalyst pump 26. The resin pump 24 and the catalyst pump 26 are connected to respective reservoirs (not shown) containing resin 28 and catalyst 30. The resin line 12 and the catalyst line 14 may be secured to each other via bands 32 to aid the insertion of the lines 12, 14 within a borehole 34. The resin and catalyst pumps 24, 26 may be chop check pumps, although other types of pumps suitable for pumping material of a high viscosity may also be utilized. The flow of each pump 24, 26 is calibrated to provide the proper ratio between the resin 28 and the catalyst 30, which is preferably 2:1 or 66% resin and 33% catalyst using a water-based catalyst. The ratio can range from about 4:1 to 3:2. With an oil-based catalyst, a 9:1+/−5% ratio is utilized. The flow of each pump 24, 26 may be calibrated by adjusting the air inlet pressure and the diameter of the outlets 18, 22 of the resin line 12 and the catalyst line 14. The resin 28 is a filled resin having 10-25% inert filler, such as limestone. The resin may have a viscosity of about 100,000-400,000 centipoise. Conventional polyurethane resin typically has a viscosity of less than 10,000 centipoise. The use of a high viscosity resin generally makes pumping more difficult, but provides significant cost savings through the use of the less expensive filler.

Referring to FIG. 1, to start the filling of the borehole 34, the resin and catalyst lines 12, 14 are inserted into the borehole 34 and the pumps 24, 26 are activated simultaneously to fill the borehole 34 with the resin 28 and catalyst 30. As the resin 28 and catalyst 30 are pumped into the borehole 34, the lines 12, 14 are forced out of the borehole 34 by the displaced material ensuring a fully filled borehole 34. Alternatively, a packer or plug (not shown) slightly smaller than the inner diameter of the borehole 34 may be installed just before the end of the lines 12, 14.

Referring to FIGS. 2 and 3, the resin 28 and the catalyst 30 will contact each other and will react to create a very fine barrier, which will prevent further reaction from occurring between the resin 28 and the catalyst 30. A mine roof bolt 36 is then inserted into the borehole 34 and rotated to mix the resin 28 and catalyst 30. After the mine roof bolt 36 has been fully inserted, as shown in FIG. 3, the mixed resin 28 and catalyst 30 hardens and cures to securely anchor the bolt 36 within the borehole 34.

Figure 4:
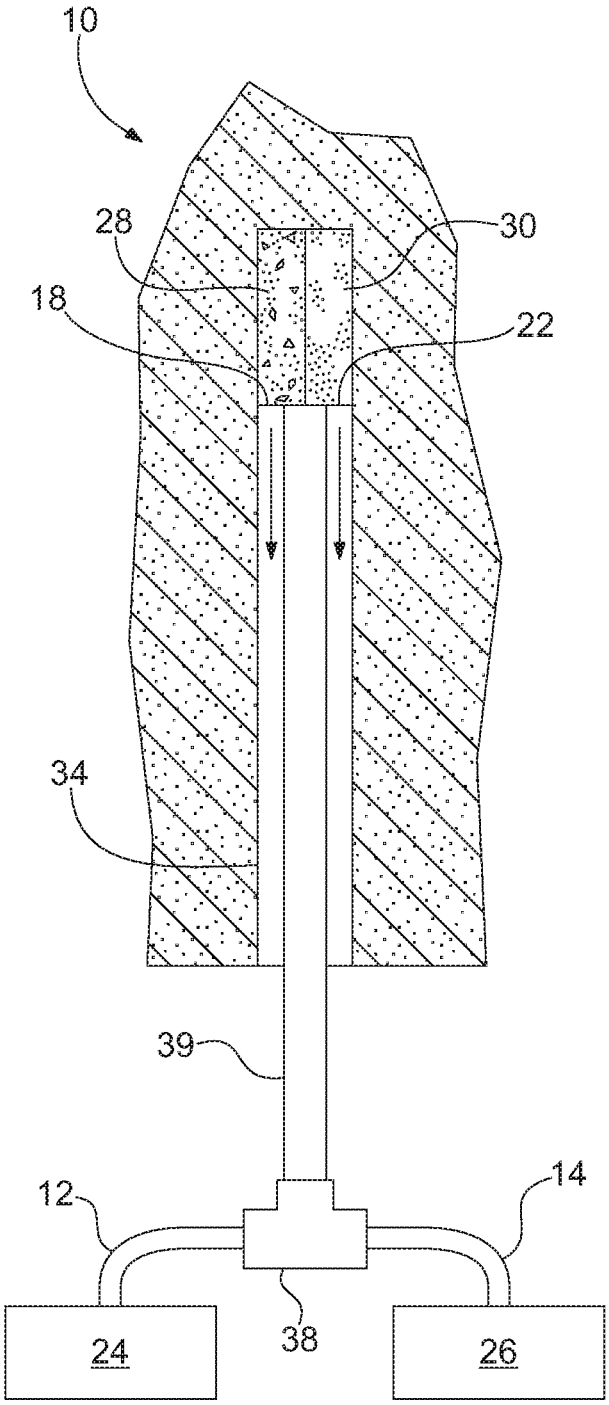
FIG. 4 is an elevational view of a pumping system and method for installing a mine roof bolt according to a second aspect of the invention.

Referring to FIG. 4, the pumpable two component resin system 10 may further include a connector 38, such as a wye or T connector, for receiving the resin line 12 and the catalyst line 14 from the resin pump 24 and the catalyst pump 26, respectively. The use of the connector 38 allows the resin and catalyst lines 12, 14 to be combined into a single grout tube 39 that is connected to the resin pump 24 and catalyst pump 26 through the connector 38. The single grout tube 39 acts as a delivery line and configured to introduce the resin 28 and catalyst 30 into the borehole 34. The system 10 using the connector 38 would operate in the same manner as described above in connection with FIGS. 1-3.

Figure 5:
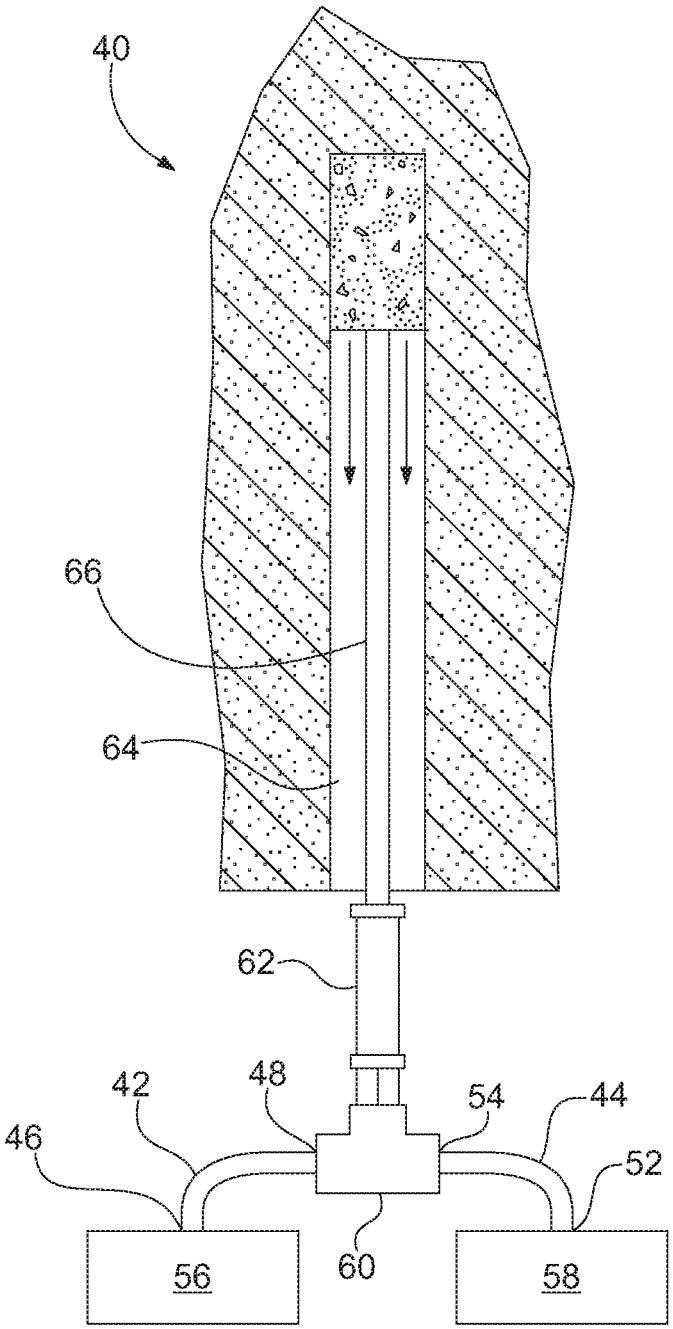
FIG. 5 is an elevational view of a pumping system and method for installing a mine roof bolt according to a third aspect of the invention.

Referring to FIG. 5, a third aspect of a pumpable two component resin system 40 includes a resin line 42 and a catalyst line 44. The resin line 42 and the catalyst line 44 each have an inlet 46, 52 and an outlet 48, 54. The inlets 46, 52 of the resin line 42 and the catalyst line 44 are connected to and in fluid communication with a resin pump 56 and a catalyst pump 58, respectively, in a similar manner as shown in FIG. 1 and discussed above. The outlets 48, 54 of the resin line 42 and the catalyst line 44, however, are connected to a connector 60, such as a wye or T fitting, which is secured to a static mixer 62. The static mixer 62 is configured to mix the resin 28 and catalyst 30 prior to being pumped into a borehole 64. A single grout tube 66 acts as a delivery line and is secured to the static mixer 62 and configured to introduce the resin and catalyst as a mixture into the borehole 64.

Figure 6:
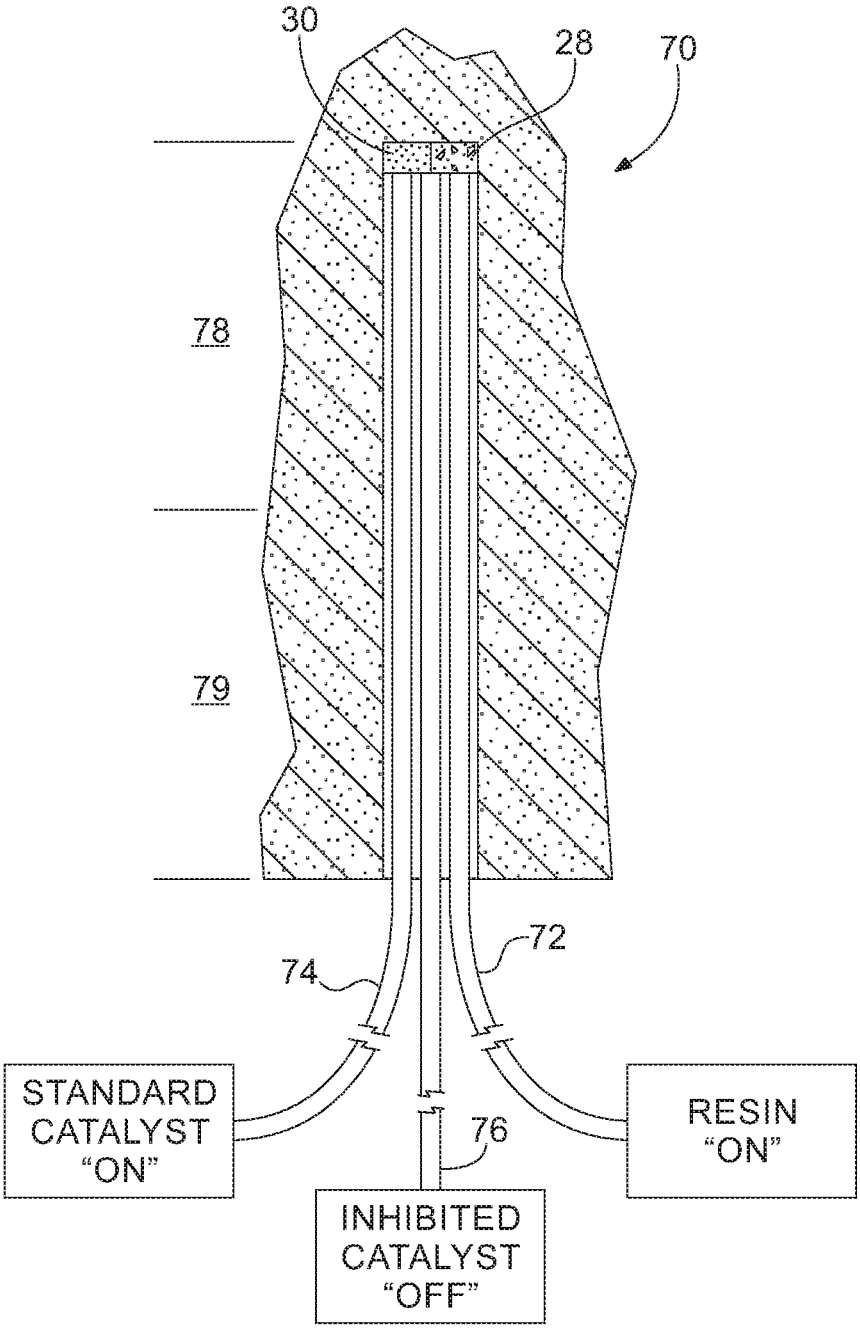
FIG. 6 is an elevational view of a pumping system and method for installing a mine roof bolt according to a fourth aspect of the invention showing the initial filling of the borehole.
Figure 7:
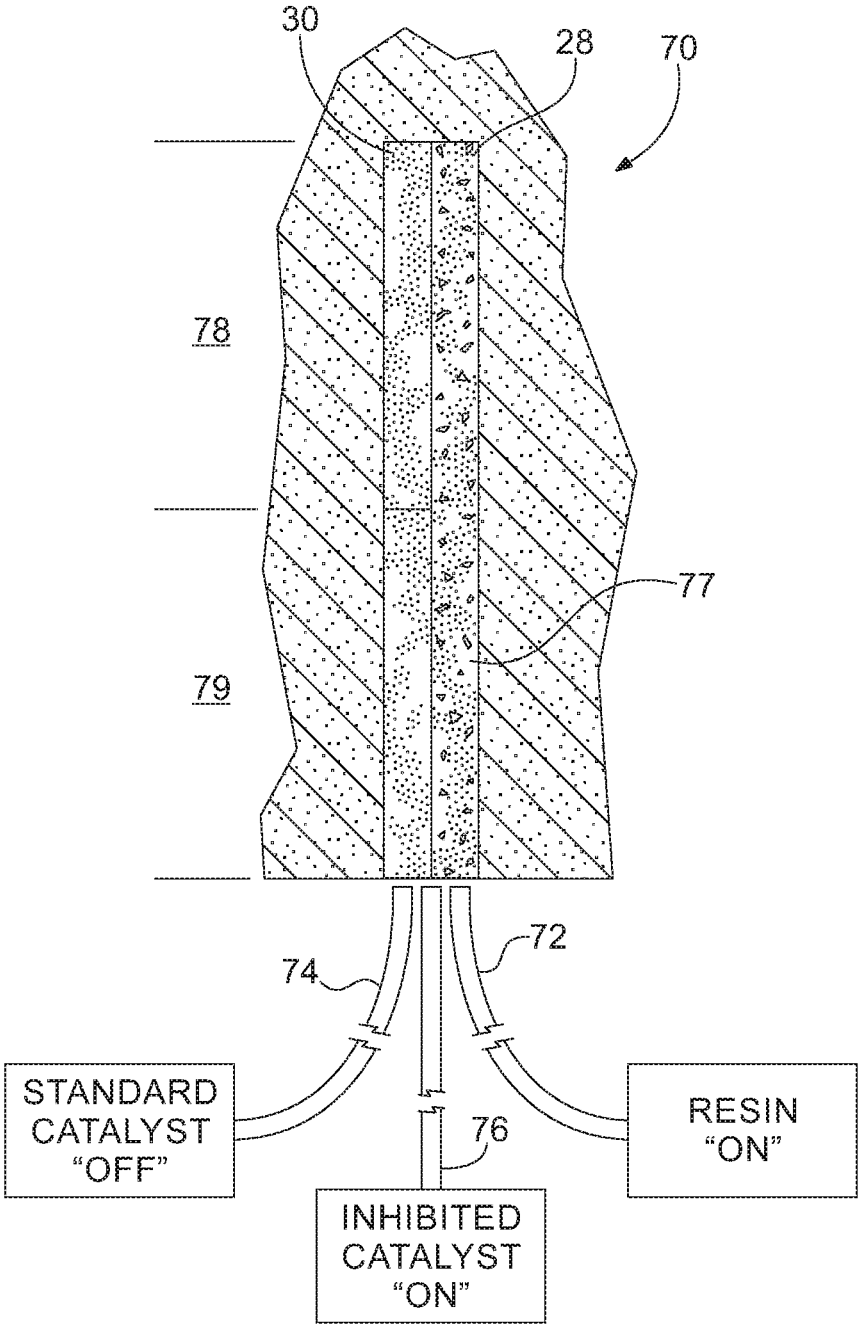
FIG. 7 is an elevational view of the system and method of FIG. 6 showing the borehole filled with a resin and a catalyst.

Referring to FIGS. 6 and 7, a fourth aspect of a pumpable two component resin system 70 includes a delivery line formed by a resin line 72, a standard catalyst line 74, and an inhibited catalyst line 76. The system 70 of FIGS. 6 and 7 operates in a similar manner to the system 10 shown in FIG. 1 and described above, but includes the inhibited catalyst line 76 to provide within the borehole 34 a fast set section 78 (such as at the blind end of the borehole 34) and a slow set section 79 (further spaced from the blind end of the borehole 34). Inhibited catalyst or inhibitor 77 reacts more slowly with the resin from the resin line 72 than the standard catalyst 30 from the standard catalyst line 74 reacts with the resin 28 from the resin line 72. The sections allow a mine roof bolt to be anchored at the fast set section and subsequently tensioned while the slow set section is still curing.

Referring again to FIGS. 6 and 7, in use, the lines 72, 74, 76 may each be inserted into the borehole 34. The resin line 72 and the standard catalyst line 74 may then be activated or placed in the "ON" state as shown in FIG. 6 such that the resin 28 and standard catalyst 30 are delivered to the borehole 34 with the inhibited catalyst line 74 placed in the "OFF" state. The resin 28 and standard catalyst 30 are provided along a predetermined length of the borehole 34 to define the fast set section 78. At that point, the standard catalyst line 74 is deactivated or placed in the "OFF" state and the inhibited catalyst line 76 is placed in the "ON" state such that resin 28 and inhibited catalyst 30 are provided along a predetermined length of the borehole to define the slow set section 79. The fast set section 78 of resin 28 and catalyst 30 will harden and set up faster than the slow set section 79 due to differences between the catalyst 30 provided by the standard catalyst line 74 and the inhibited catalyst line 76, which allows a mine roof bolt to be installed and point anchored at the blind end of the borehole 34 and subsequently tensioned while the slow set section 79 is still curing.

Figure 8:
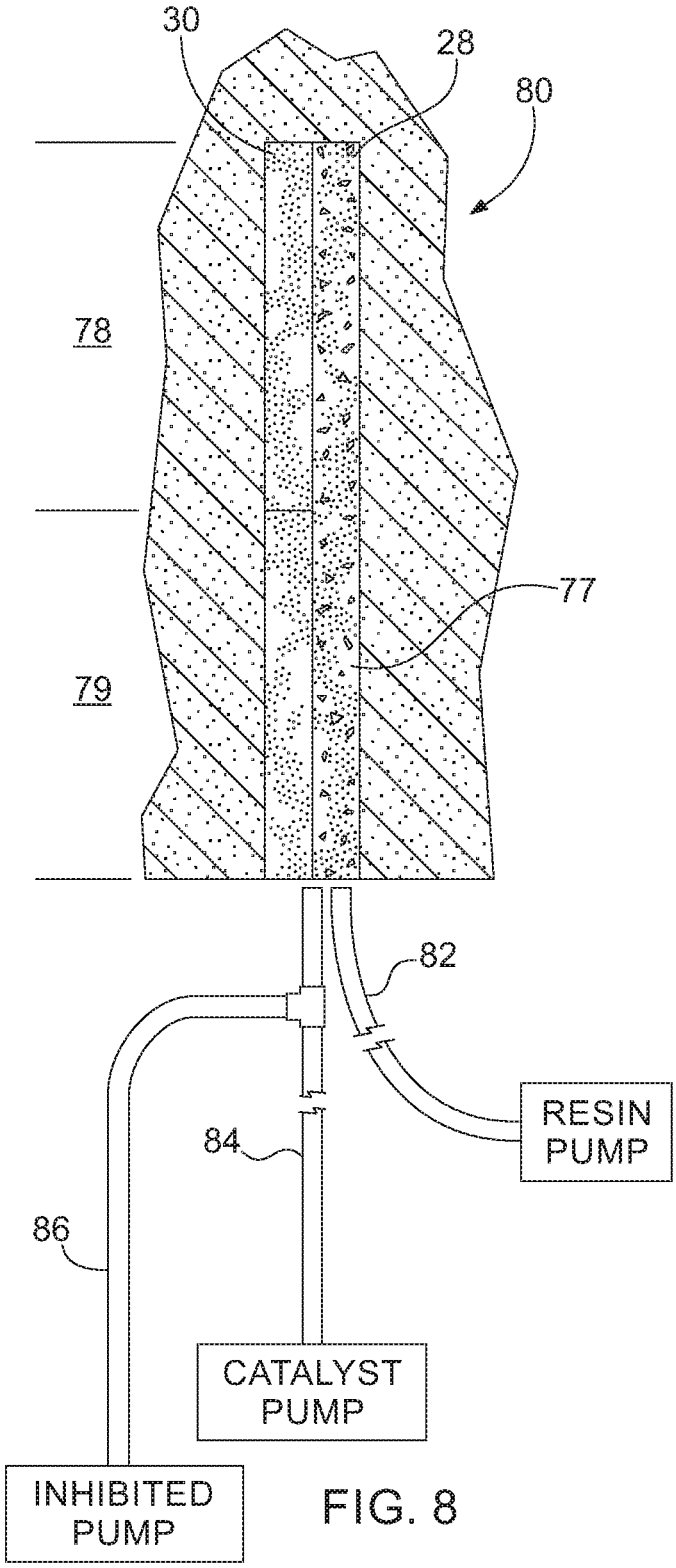
FIG. 8 is an elevational view of a pumping system and method for installing a mine roof bolt according to a fifth aspect of the invention.

Referring to FIG. 8, a fifth aspect of a pumpable two component resin system 80 includes a resin line 82, a standard catalyst line 84, and a catalyst inhibitor line 86. The system 80 of FIG. 8 is similar to the system shown in FIGS. 6 and 7 and described above, but feeds the catalyst inhibitor line 86 directly to the standard catalyst line 84. The catalyst inhibitor line 86 would only be operated or pumped at the sections where a slower set time is desired. Connecting the catalyst inhibitor line 86 to the standard catalyst line 84 prevents the need for a third line positioned within the borehole 34. This system 80 could also be utilized by pre-mixing the resin and the catalyst. The system 80 may also utilize two or more resin compositions in addition to using two or more catalysts. In particular, the system 80 may utilize a plurality of resins and catalysts to optimize their performance and cost.

Figure 9:
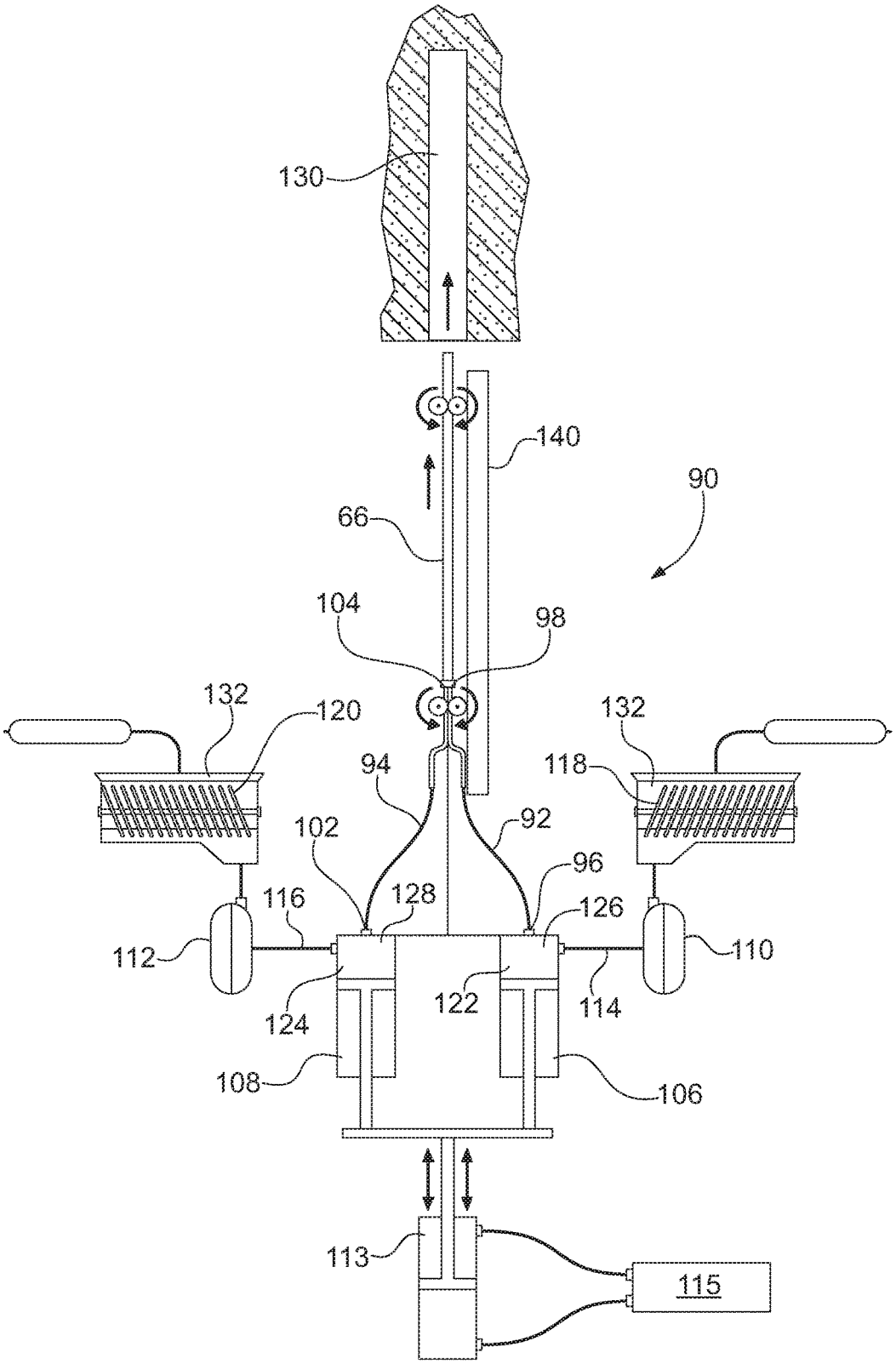
FIG. 9 is an elevational view of a pumping system and method for installing a mine roof bolt according to a sixth aspect of the invention.

Referring to FIG. 9, a sixth aspect of a pumpable two component resin system 90 includes a resin line 92 and a catalyst line 94. The resin line 92 and the catalyst line 94 each have an inlet 96, 102 and an outlet 98, 104. The inlet 96 of the resin line 92 is connected to and in fluid communication with a resin cylinder pump 106. The inlet 102 of the catalyst line 94 is connected to and in fluid communication with a catalyst cylinder pump 108. The outlets 98, 104 are connected to a grout tube 66 acting as a delivery line, although other suitable arrangements may be utilized. The resin cylinder pump 106 and the catalyst cylinder pump 108 are connected to respective supply pumps 110, 112 via a resin supply line 114 and a catalyst supply line 116. The supply pumps 110, 112 pump resin 126 and catalyst 128 from respective reservoirs 118, 120 through the respective resin supply line 114 and catalyst supply line 116 and into the respective resin cylinder pump 106 and catalyst cylinder pump 108. As shown in FIG. 9, the resin cylinder pump 106 and the catalyst cylinder pump 108 are slaved together to inject the resin 126 and catalyst 128 at about a constant 2:1 volumetric ratio, although other suitable ratios may be utilized. The slaved pumps 106, 108 are controlled by a separate piston 113, which is operated by a hydraulic pump 115. The hydraulic pump 115 may have a maximum output pressure of 1,200 psi, which has been demonstrated to be effective in injecting resin 126 and catalyst 128 into a borehole 130 through a ½" diameter tube over 50 feet in length, although other suitable pumps may be utilized.

Figure 11:
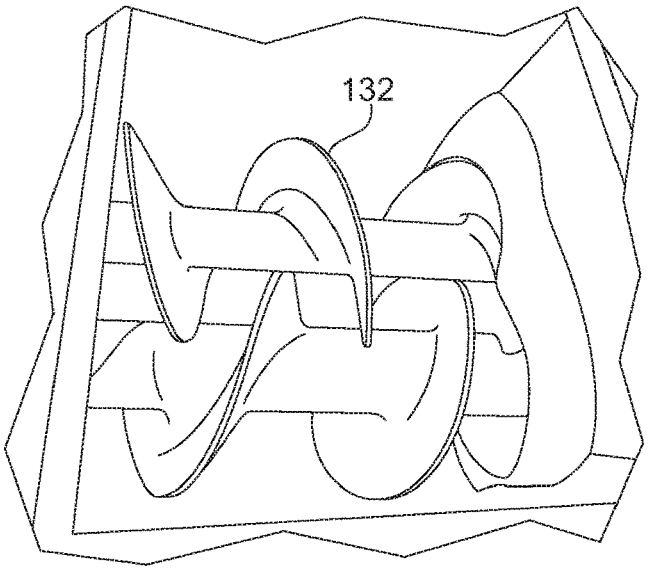
FIG. 11 is a perspective view of a twin auger arrangement for a hopper according to one aspect of the invention.

The supply pumps 110, 112 are diaphragm pumps, although other types of pumps suitable for pumping material of a high viscosity may also be utilized, such as chop check pumps, progressive cavity pumps, etc. The pumpable two component resin system 90 shown in FIG. 9 generally operates in the same manner as the system 10 shown in FIGS. 1-3 and discussed above. The supply pumps 110, 112 are used to fill respective cylinders 122, 124 of the resin cylinder pump 106 and catalyst cylinder pump 108 to a predetermined level for each of the cylinders 122, 124. The resin cylinder pump 106 and the catalyst cylinder pump 108 are then activated to dispense resin 126 and catalyst 128 simultaneously. In order to obtain the desirable resin to catalyst ratio, the resin cylinder 122 should generally be about two times larger in volume relative to the catalyst cylinder 124. In a similar manner as shown in FIGS. 2 and 3, the resin 126 and catalyst 128 will fill the borehole 130 and then a bolt is subsequently inserted into the borehole 130. The resin cylinder pump 106 and the catalyst cylinder pump 108 may then be recharged via the supply pumps 110, 112. The reservoirs 118, 120 may each be hoppers with a twin auger arrangement 132, which is shown more clearly in FIG. 11, although other suitable reservoir arrangements may be utilized. The twin auger arrangement 132 allows the components to be continuously mixed to prevent separation or drying out of the resin and catalyst 126, 128. The reservoirs 118, 120 may be supplied using large "chubs" or cartridges 139 or other containers containing the resin and catalyst 126, 128. As discussed in more detail below, the grout tube 66 is connected to a bolter arm 140 and is moveable relative to the bolter arm 140 to allow the insertion of the grout tube 66 within the borehole 130 for delivery of the grout. The system shown in FIG. 9 may utilize any other arrangements shown in FIGS. 1-8 and described above.

Figure 10:
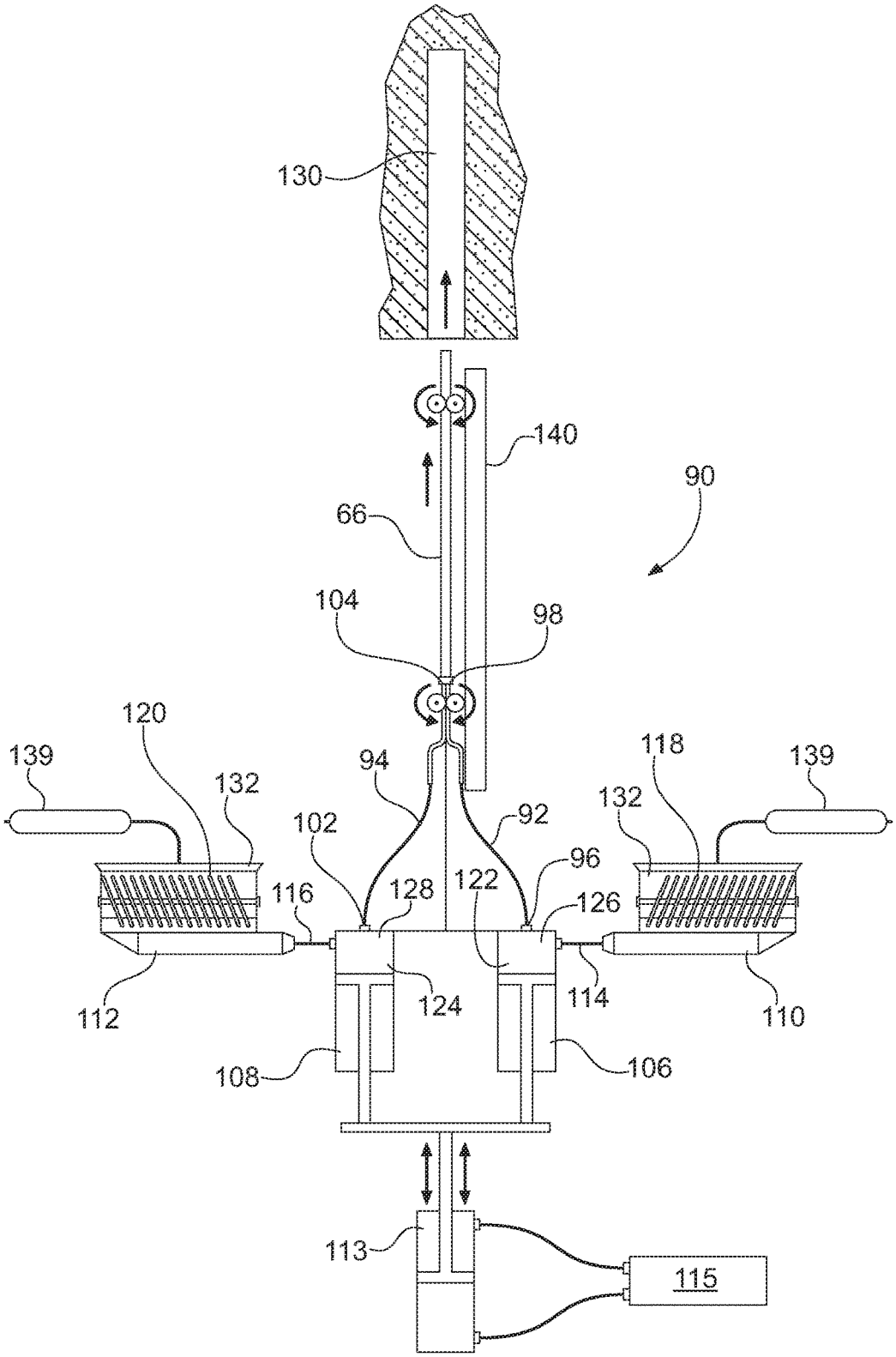
FIG. 10 is an elevational view of a pumping system and method for installing a mine roof bolt according to a seventh aspect of the invention.

Referring to FIG. 10, the pumpable two component resin system 90 shown in FIG. 9 and described above may utilize progressive cavity pumps for the supply pumps 110, 112 rather than the diaphragm pumps shown in FIG. 9. The system 90, however, would operate in the same manner as described above.

Figure 12A:
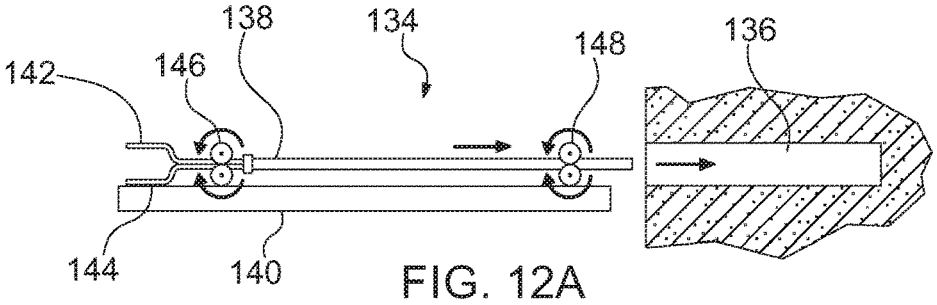
FIGS. 12A-12D are elevational views showing a method of installing a mine roof bolt according to one aspect of the invention.
Figure 12B:
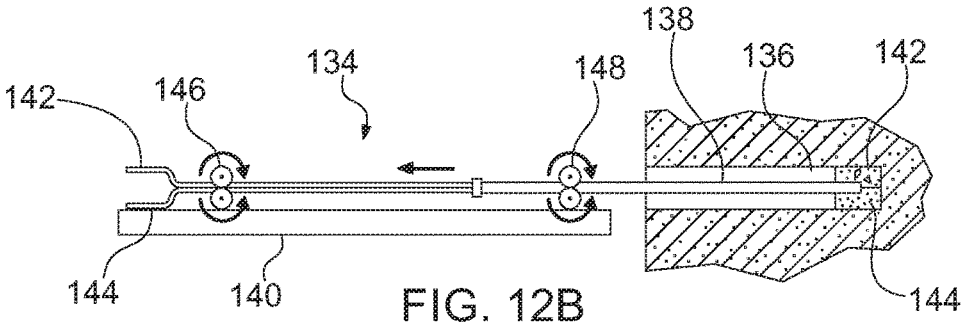
Figure 12C:
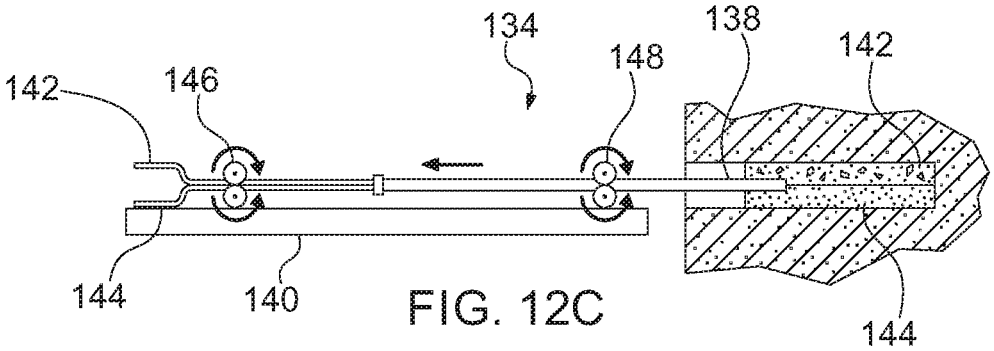
Figure 12D:
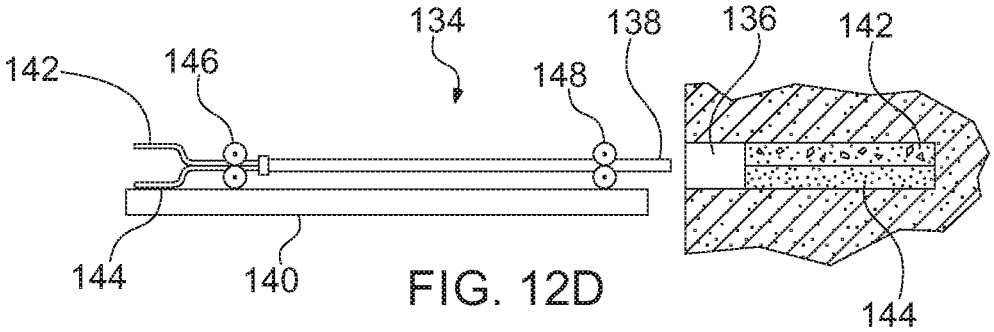

Referring to FIGS. 12A-12D, one aspect of a method 134 for installing a mine roof bolt is shown. The method 134 may provide an automated arrangement for injecting and installing a mine roof bolt using a bolting machine (not shown). After drilling a borehole 136 using a bolting machine, a grout tube 138 is inserted into the borehole 136 using the bolter arm 140 of the bolting machine as shown in FIG. 12A. Resin and catalyst components 142, 144 are injected into the borehole 136 and the grout tube 138 is retracted at a suitable rate to prevent air pockets or the flow of resin and catalyst 142, 144 from bypassing the tip of the grout tube 138 as shown in FIGS. 12B and 12C. Once the required amount of resin and catalyst 142, 144 is provided within the borehole 136, the grout tube 138 is removed from the borehole 136 as shown in FIG. 12D. A mine roof bolt may be subsequently inserted into the borehole 136 and rotated to mine the resin and catalyst 142, 144 in the same manner as described above in connection with FIGS. 1-3. Further, the method shown in FIGS. 12A-12D may utilize any of the systems and arrangements shown in FIGS. 1-11. The bolting machine may be configured to automatically drill the borehole 136, inject the resin and catalyst 142, 144 into the borehole 136, and install a mine roof bolt by inserting the bolt into the borehole 136 and rotating the bolt to mix the resin and catalyst 142, 144. The bolting machine may utilize a controller, such as a PLC, and one or more sensors to control the installation of the mine roof bolt. The grout tube 138 may be driven by a first and second set of drive wheels 146, 148, although any suitable arrangement for inserting and retracting the grout tube 138 may be utilized.

Figure 13:
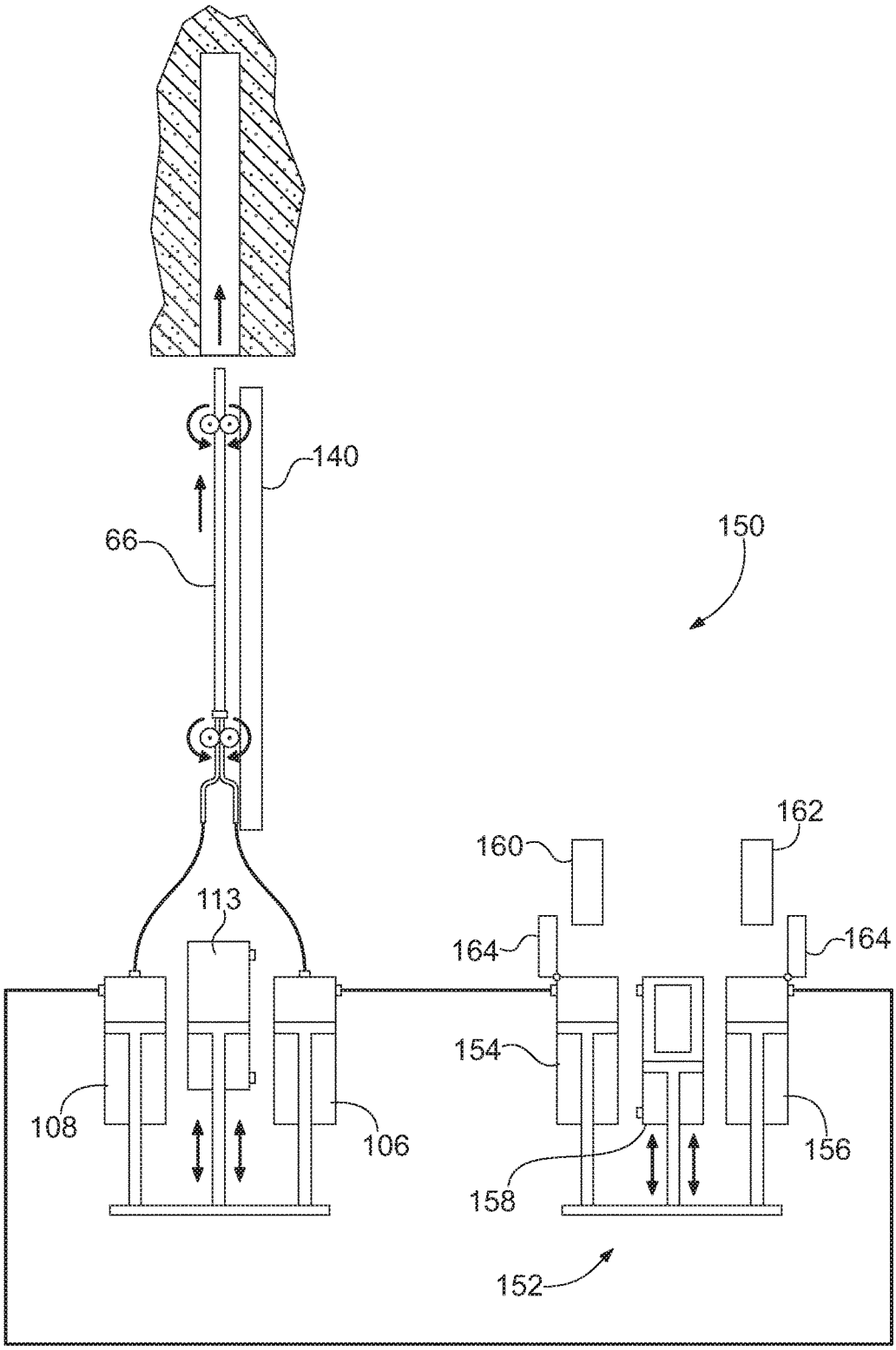
FIG. 13 is an elevational view of a pumping system and method for installing a mine roof bolt according to a further aspect of the invention.

Referring to FIG. 13, a pumpable two component resin system 150 is similar to the system 90 shown in FIG. 9 and discussed above. However, rather than utilizing supply pumps 110, 112 as in the system 90 of FIG. 9, the system 150 of FIG. 13 utilizes a feed pump arrangement 152 having a resin feed cylinder 154 and a catalyst feed cylinder 156 that are slaved together to feed the resin cylinder pump 106 and catalyst cylinder pump 108, respectively. The cylinders 154, 156 are controlled by a main piston 158, which is operated by a hydraulic pump (not shown). The resin feed cylinder 154 and catalyst feed cylinder 156 may be supplied with resin and catalyst cartridges 160, 162 or other suitable arrangements as discussed above. The resin and catalyst cartridges 160, 162 may be fed into the cylinders 154, 156 by removing a cap 164, which is discussed in more detail below and shown in FIGS. 15 and 16.

Referring to FIGS. 14A-14D, further methods of installing a mine roof bolt using the systems 10, 40, 70, 80, 90 discussed above are shown. The mixing and/or non-mixing of the resin and catalyst can be controlled during injection by the amount of turbulence introduced into a grout injection line. The basic properties that control the amount of turbulence are the viscosities of the two components, the internal diameter and length of the injection tube, and the flow rate. Changes in any of these parameters can change the characteristics of the flow from turbulent (mixing) to laminar (non-mixing). This flow rate property and being able to control whether the flow is turbulent or laminar, or a combination thereof, is important for proper installation of mine roof bolts in the systems 10, 40, 70, 80, 90 discussed above. In certain situations, mixing of the resin and catalyst is undesirable because the resin can set before the bolt can be installed. However, in other situations, fully mixing or partially mixing the resin and catalyst during injection may be desirable.

Figure 14A:
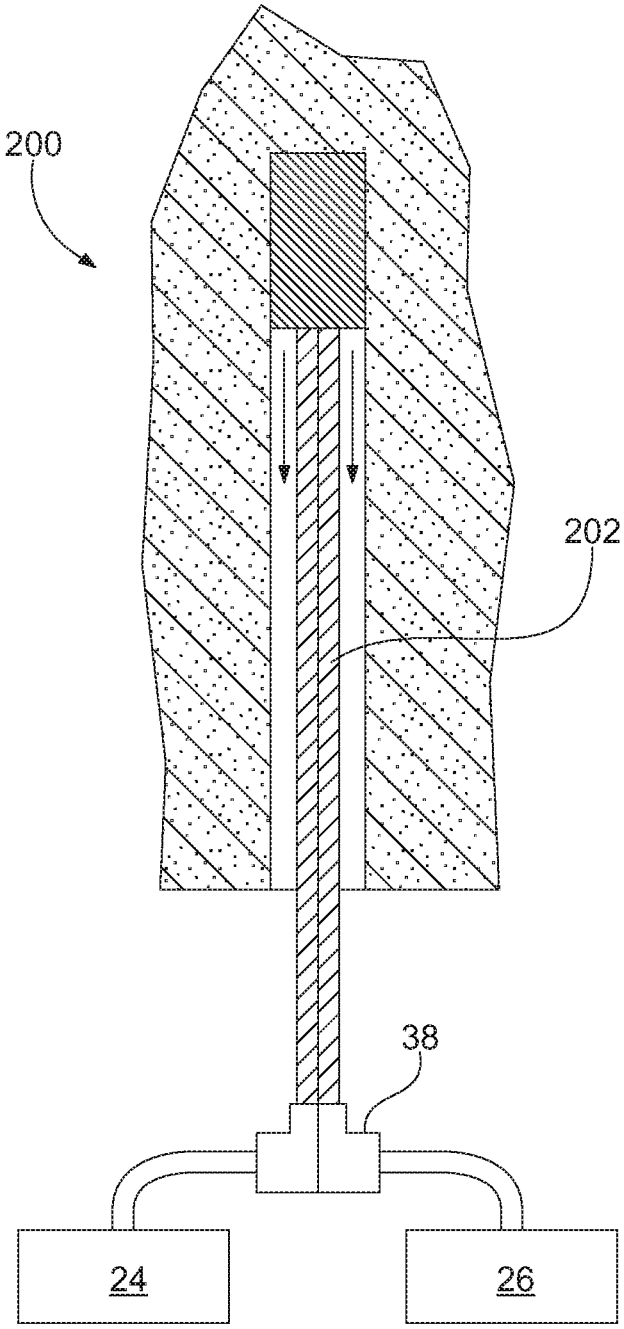
FIGS. 14A-D are elevational views showing various methods of installing a mine roof bolt according to one aspect of the invention.
Figure 14B:
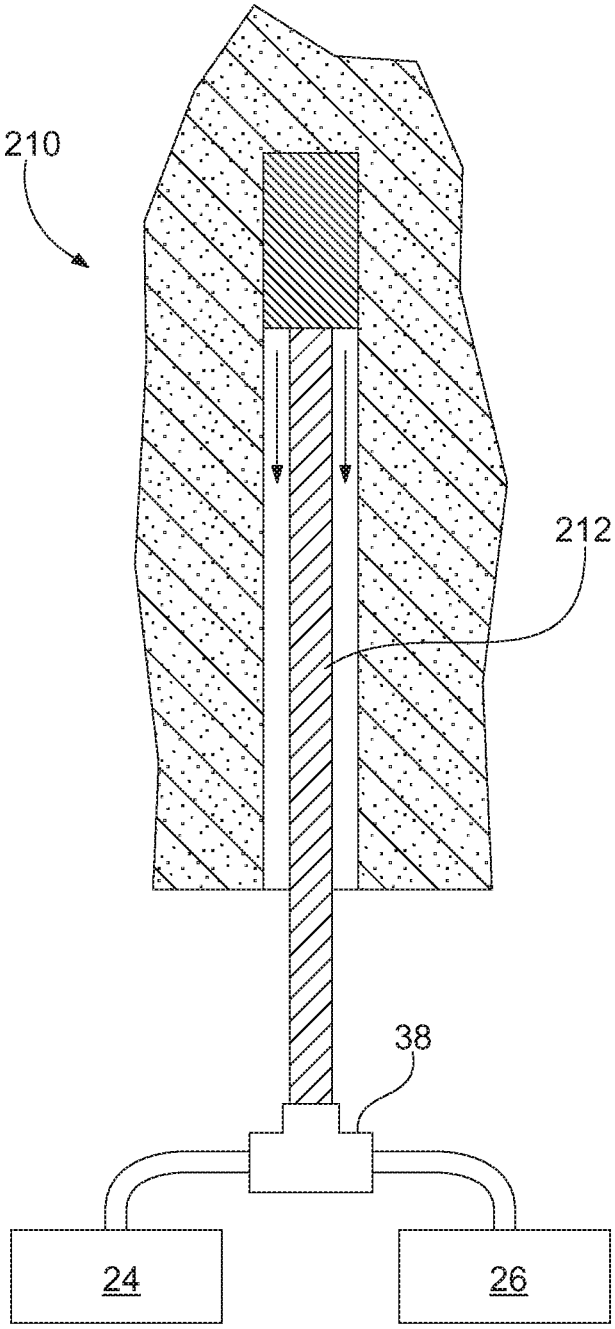

Referring to FIG. 14A, a system 200 uses a divided injection tube 202 in order to keep the two components separate. When the resin and catalyst exit the injection tube they will lay side by side in the borehole. Turbulent and laminar flow is not an issue with this system 200 and method. The method of using this system 200 typically includes: drilling the borehole; inserting the injection tube 202 into the borehole; pumping resin and catalyst at any flow rate to prevent mixing; simultaneously with pumping the resin and catalyst, retracting the injection tube 202 at a set rate to prevent voids and flowback ahead of the injection tube 202; and installing a mine roof bolt (not shown) and spinning the mine roof bolt to mix the resin and catalyst. Typical properties for this method are below:

Resin Viscosity: 125,000-225,000 cps
Catalyst Viscosity: 10,000-25,000 cps
Injection Line ID: ¾"
Injection Line Length: 14'
Flow Rate: 1-3 gpm Referring to FIG. 14B, a system 210 utilizes a single injection line 212. The typical size of the injection line 212 is ¾" for a 33 mm borehole. The resin and catalyst are pumped into the Wye at a slower rate in order to keep the flow laminar. The resin and catalyst will lay side by side with minuscule mixing. As the resin and catalyst exits the injection line 212, the resin and catalyst will remain side by side in the borehole. The mine roof bolt is then inserted into the separated resin and catalyst and rotated to mix resin and catalyst. Typical properties for this method are below:

Resin Viscosity: 200,000-225,000 cps
Catalyst Viscosity: 20,000-25,000 cps
Injection Line ID: ¾"
Injection Line Length: 14'
Flow Rate: 1-1.5 gpm With the method of using the system 210 of FIG. 14B, if the flow rate is increased from laminar flow to an intermediate flow rate, minor mixing will occur in the injection line 212. This flow rate is about 1.5 gpm. The minor mixing of the resin and catalyst will cause small hardened flakes of mixed resin and catalyst ⅛" wide by ½" in length by 1/16" thick to form within the raw resin and catalyst as the resin and catalyst are injected. Approximately only 10% of the resin may react with the catalyst during this partial mixing process. The reacted pieces of resin/catalyst act as small mixing blades when a mine roof bolt is installed.

The method of using this system 210 typically includes: drilling the borehole; inserting the injection line 212 into the borehole; pumping resin and catalyst at a laminar flow rate to prevent mixing; simultaneously with pumping, retracting the injection line 212 at a set rate to prevent voids and flowback ahead of the injection line 212; and installing a mine roof bolt (not shown) and spinning the bolt to mix the resin and catalyst.

Figure 14C:
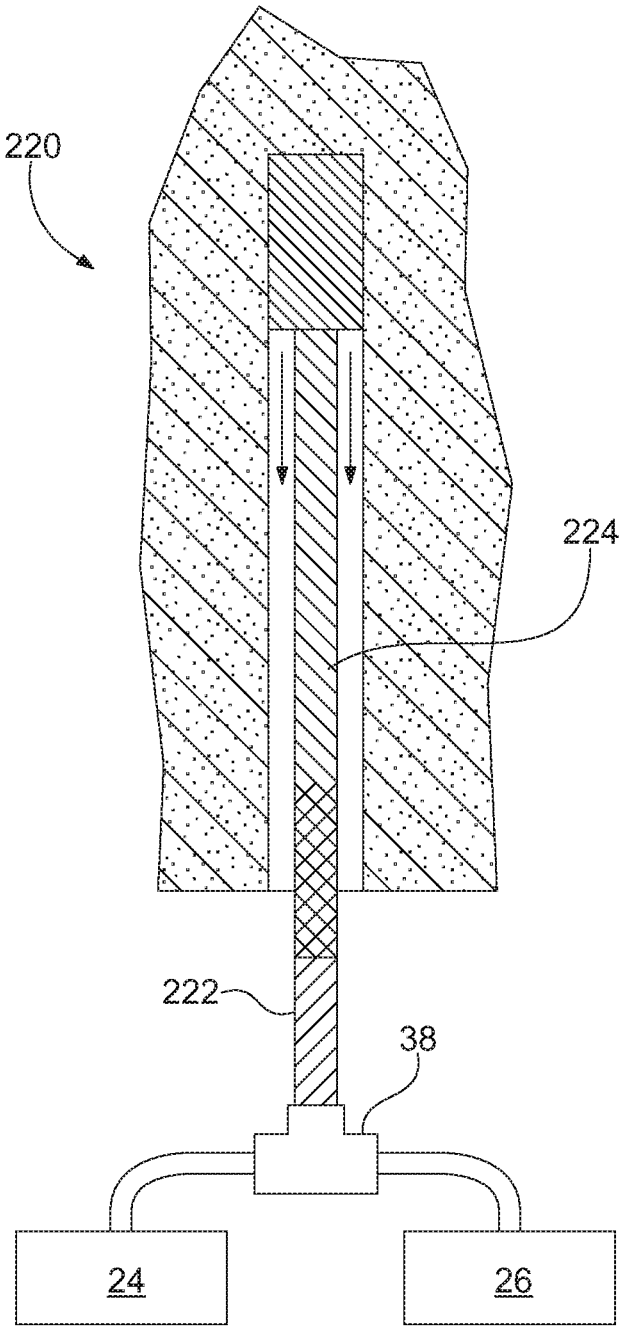

Referring to FIG. 14C, a system 220 uses a single injection line 222. The typical size of the injection line 222 is ¾". The resin and catalyst are pumped into the Wye at a faster rate to create an intermediate to turbulent flow. The resin and catalyst will mix as it flows through the injection tube 222. In one aspect of this method, a grout tube 224 may be attached to the mine roof bolt and remain in the cured resin/catalyst mixture. However, in other aspects, the mine roof bolt may be installed after injection of the resin and catalyst as described above in connection with the system of FIG. 14B. Typical properties for this method are below:

Resin Viscosity: 125,000-150,000 cps
Catalyst Viscosity: 10,000-15,000 cps
Injection Line ID: ¾"
Injection Line Length: 14'
Flow Rate: 2.0-2.5 gpm The method of installing the system 220 of FIG. 14C typically includes: drilling the borehole; connecting the injection line 222 to the grout tube 224 which lays alongside the mine roof bolt (not shown) or inserting the injection line 222 into the end of the borehole; pumping a predetermined amount of resin and catalyst into the borehole at a turbulent flow rate to allow mixing of the resin and catalyst; and stopping the pumping when the borehole is full. The mine roof bolt will be completely installed and no spinning of the mine roof bolt will be necessary due to the turbulent flow and prior mixing of the resin and catalyst.

Figure 14D:
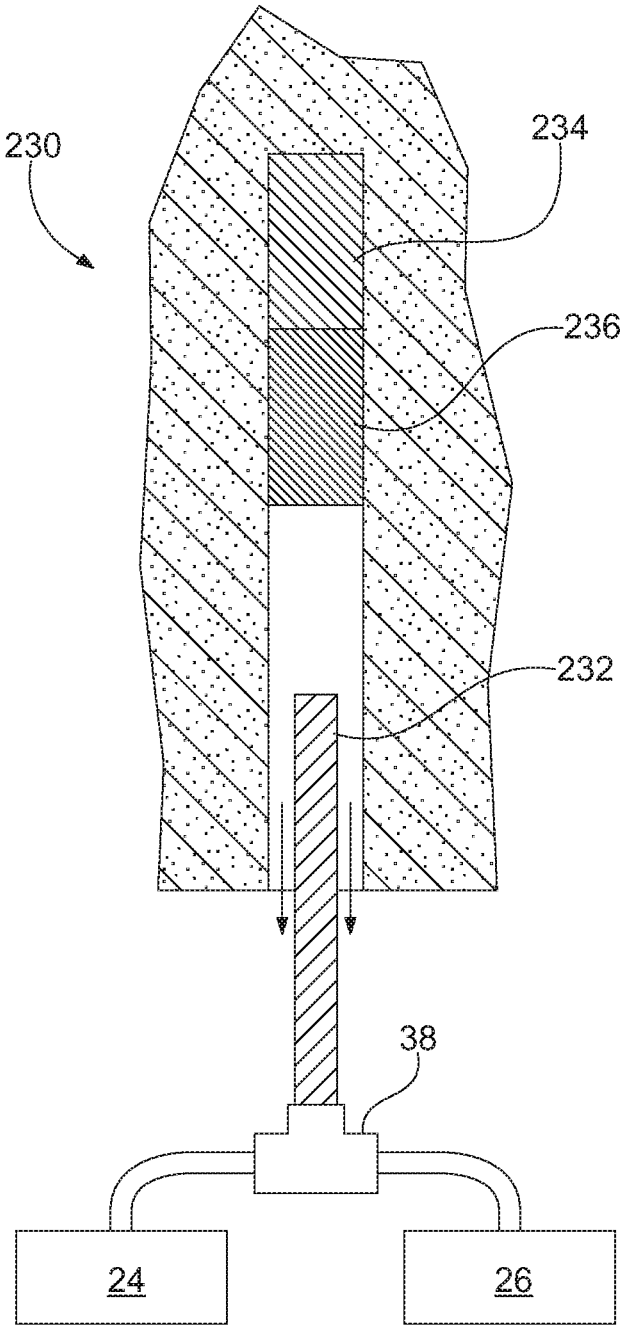

Referring to FIG. 14D, a system 230 utilizes a single injection line 232 and creates a point anchored arrangement. The typical size of the injection line 232 is ¾" for a 33 mm borehole. At the start of injection, the resin and catalyst are pumped into the Wye at a fast rate to create turbulent (mixing) flow then at a predetermined position, the flow is switched to a laminar (non-mixing) flow. The mixed resin/catalyst at a top section 234 of the borehole starts to react where the resin and catalyst at a bottom portion 236 of the borehole does not react or setup. A mine roof bolt (not shown) is quickly installed and spun to mix the bottom section 236 starting the reaction time for the mixed resin and catalyst. The top section 234, which was mixed during injection, will set before the bottom section 236 to allow the bolt to be torqued thereby creating tension in the bolt before the bottom section 236 sets. The system 230 is similar to a point anchored rebar bolt that uses a fast resin/catalyst cartridge at the top and a slow resin/catalyst cartridge at the bottom. Typical properties for this method are below:

Resin Viscosity: 125,000-225,000 cps
Catalyst Viscosity: 10,000-25,000 cps
Injection Line ID: ¾"
Injection Line Length: 14'
Flow Rate: 1-2.5 gpm The method of installing the system of FIG. 14D typically includes: drilling the borehole; inserting the injection line 232 into the end of the borehole; pumping a predetermined about of resin and catalyst into the borehole at a turbulent flow rate to allow mixing of resin and catalyst; after a predetermined length of time or amount of resin and catalyst supplied at a turbulent flow rate, switching to a laminar flow rate of the resin and catalyst to prevent mixing; simultaneously with the turbulent and laminar flow rate pumping, retracting the injection line 232 at a set rate to prevent voids and flowback ahead of the injection line; and installing a mine roof bolt (not shown) and spinning the mine roof bolt to mix the resin and catalyst. As noted above, the top section 234 of resin/catalyst injected with a turbulent flow rate, thereby mixing the resin and catalyst, will set first to allow a drive member, such as a nut, at the bottom of the mine roof bolt to be torqued to the tension the mine roof bolt.

Figure 15:
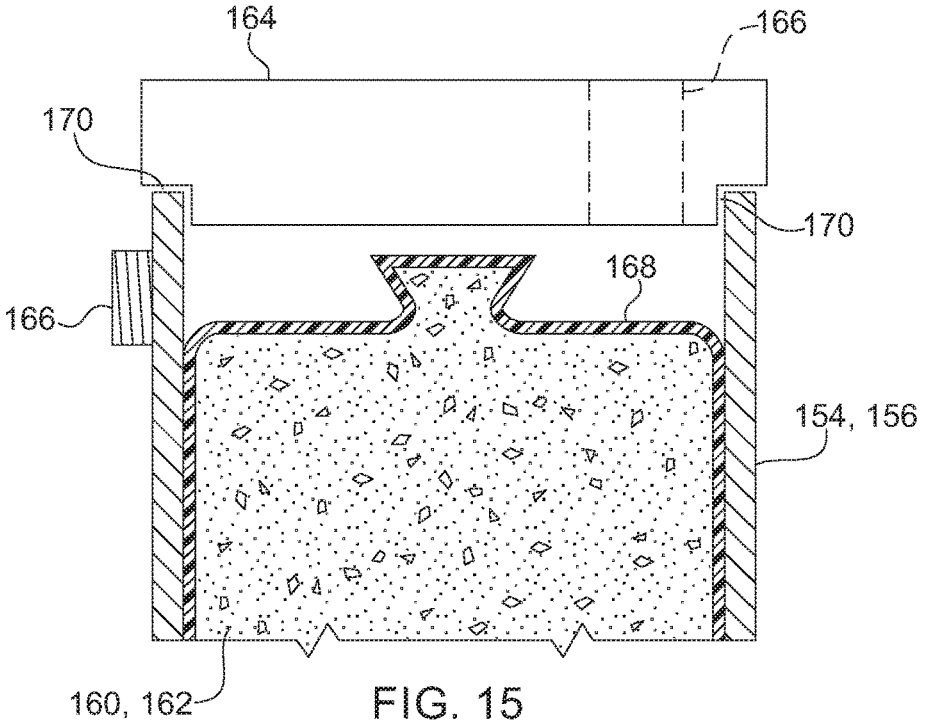
FIG. 15 is a partial cross-sectional view of a pumping arrangement according to one aspect of the invention, showing an initial position of the pumping arrangement.
Figure 16:
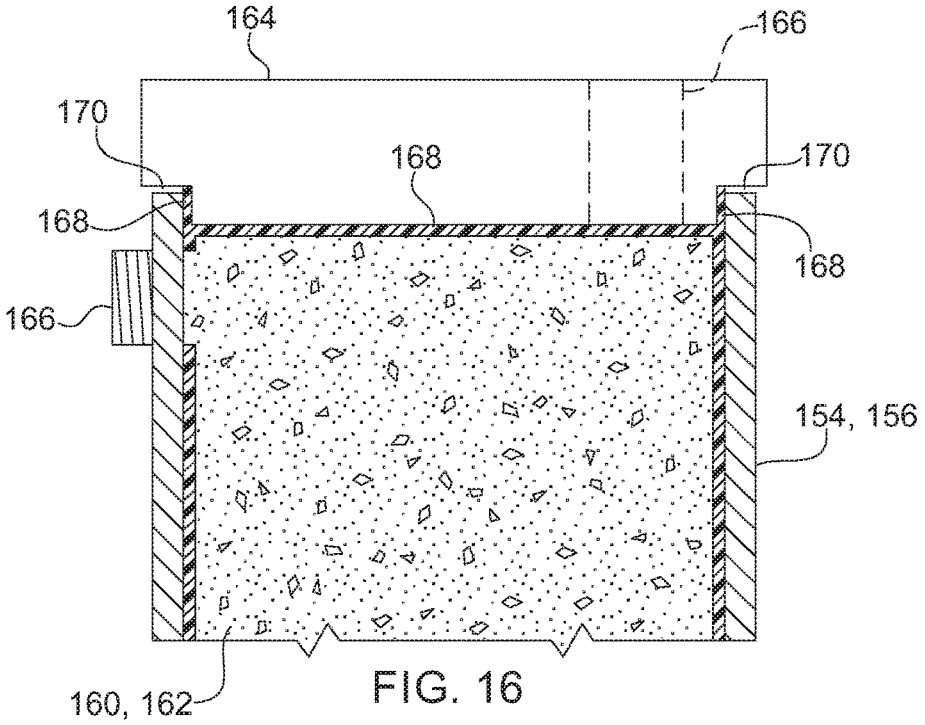
FIG. 16 is a partial cross-sectional view of a pumping arrangement according to one aspect of the invention, showing a pumping position of the pumping arrangement.

Referring to FIGS. 15 and 16, the resin and catalyst cartridges 160, 162 may be fed into the cylinders 154, 156 by removing the cap 164. The cap 164 may be moveable relative to the cylinders 154, 156 via any suitable arrangement. The cap 164 may be hinged, laterally moveable using a gate valve-like arrangement, or may be vertically moveable with the cylinders 154, 156 being moveable via a sliding base. The resin and catalyst cartridges 160, 162 may be provided with various resin to catalyst ratios from about 1:1 to 95:5. In one aspect, the ratio may be about 2:1 with the resin and catalyst provided separately in the cartridges 160, 162. The cylinders 154, 156 include a port 166 extending through a sidewall of the cylinders 154, 156, although the port 166 may also be provided in the cap 164 as indicated by dashed lines in FIGS. 15 and 16. The port 166 may be a ¾" hose connection port, although other suitable connections and ports may be utilized. The cartridges 160, 162 include a body 168 that defines a space for receiving the resin or catalyst. The body 168 may be formed from a non-reactive plastic materials, such as Nylon, Polypropylene, or polytetrafluoroethylene-based material, although other suitable materials may be utilized. The resin cartridge 160 may be 6" in diameter and the catalyst cartridge 162 may be 4" in diameter with each cartridge 160, 162 having a height of 14", which corresponds to the size of the cylinders 154, 156, although suitable sizes may be utilized.

Referring again to FIGS. 15 and 16, the cap 164 and the cylinders 154, 156 define a gap 170 between the cap 164 and the cylinders 154, 156. The gap 170 allows air to escape from within the cylinders 154, 156 during the initial compression of the cartridges 160, 162 within the cylinders 154, 156. If the lid 164 forms an air-tight seal with the cylinders 154, 156, air would become trapped within the cylinders 154, 156 and would eventually be forced out through the grout tube 66 causing undesirable air bursts or pops, uneven flow, and/or turbulent mixing of the resin and catalyst. As shown in FIG. 16, when the cartridges 160, 162 are compressed, the air will escape through the gap 170 with the body 168 of the cartridges 160, 162 expanding to self-seal the gap 170 between cap 164 and the cylinders 154, 156. Thus, the cap 164 and cylinders 154, 156 form a self-sealing design where resin and catalyst does not escape through the gap 170 and where the plastic bag does not break or extrude through the gap 170. Further, when the cartridges 160, 162 are compressed and pressurized, the body 168 of the cartridges 160, 162 will only be punctured at the location of the port 166 and flow directly into the port 166 for eventual delivery to the borehole. When the cylinders 154, 156 are fully compressed, only the body 168 of the cartridges 160, 162 and a minimal amount of resin or catalyst will remain. The body 168 of the cartridges 160, 162 may then be discarded and the cylinders 154, 156 can be reloaded with full cartridges 160, 162. This arrangement of the cylinders 154, 156, cartridges 160, 162, and cap 164 keeps the cylinders 154, 156 clean during use for easy loading and unloading and protects the seals of the piston of the cylinders 154, 156 from wear from the resin material.

While various aspects of the system were provided in the foregoing description, those skilled in the art may make modifications and alterations to these aspects or aspects without departing from the scope and spirit of the invention. For example, it is to be understood that this disclosure contemplates that, to the extent possible, one or more features of any aspect or aspect can be combined with one or more features of any other aspect or aspect. Accordingly, the foregoing description is intended to be illustrative rather than restrictive. The invention described hereinabove is defined by the specification, and all changes to the invention that fall within the meaning and the range of equivalency of the specification are to be embraced within its scope.

The invention claimed is:

1. A pumpable resin system for installation of mine roof bolts comprising:

a resin feed cylinder configured to receive a resin container;

a catalyst feed cylinder configured to receive a catalyst container;

a resin cylinder pump in fluid communication with the resin feed cylinder, the resin feed cylinder configured to transfer resin to the resin cylinder pump;

a catalyst cylinder pump in fluid communication with the catalyst feed cylinder, the catalyst feed cylinder configured to transfer catalyst to the catalyst cylinder pump;

a resin line in fluid communication with the resin cylinder pump; and a catalyst line in fluid communication with the catalyst cylinder pump, wherein the resin feed cylinder and the catalyst feed cylinder each comprise a cap, the cap of the resin feed cylinder defining a gap between the cap of the resin feed cylinder and the resin feed cylinder, and the cap of the catalyst feed cylinder defining a gap between the cap of the catalyst feed cylinder and the catalyst feed cylinder, and wherein the gaps are configured to allow air to escape the respective resin feed cylinder and the catalyst feed cylinder during compression of resin and catalyst containers within the respective resin feed cylinder and the catalyst feed cylinder.

2. The system of claim 1, further comprising a bolter arm configured to drill boreholes and install mine roof bolts, wherein the resin line and the catalyst line are configured to deliver resin and catalyst from the resin feed cylinder and the catalyst feed cylinder to a borehole via the bolter arm.

3. The system of claim 1, wherein the resin line and the catalyst line are received by a static mixer, and wherein a grout tube is in fluid communication with the static mixer, the grout tube configured to deliver a resin/catalyst mix into a borehole.

4. The system of claim 1, further comprising an inhibitor pump arrangement and an inhibitor line in fluid communication with the inhibitor pump arrangement, the inhibitor line configured to deliver inhibitor to the borehole to define a fast set section and a slow set section within a borehole.

5. The system of claim 1, wherein the resin cylinder pump and the catalyst cylinder pump are slaved together and controlled by a hydraulic piston and hydraulic pump.

* * * * *